United States Patent [19]

Finney

[11] 4,090,736

[45] May 23, 1978

[54] DETACHABLE CAB CONSTRUCTION FOR MINING MACHINES

[75] Inventor: James L. Finney, Cranbury, N.J.

[73] Assignee: The United States of America as represented by the Secretary of the Interior, Washington, D.C.

[21] Appl. No.: 771,500

[22] Filed: Feb. 24, 1977

[51] Int. Cl.[2] ..... E21C 33/00

[52] U.S. Cl. ..... 299/30; 175/86; 175/219; 180/89.1

[58] Field of Search ..... 299/12, 30; 180/89.12, 180/89 R, 89.13, 77 MC, 77 S, 77 C; 175/219, 86

[56] References Cited

U.S. PATENT DOCUMENTS

| | | | |
|---|---|---|---|
| 3,912,024 | 10/1975 | Richmond et al. | 299/30 X |
| 4,022,026 | 5/1977 | Childress | 175/219 X |

OTHER PUBLICATIONS

"Cable & Wireless Remote Control of Continuous Miners", Mining Congress Journal, Oct. 1974, pp. 34–39.

*Primary Examiner*—Ernest R. Purser

*Attorney, Agent, or Firm*—Gersten Sadowsky; Donald A. Gardiner

[57] ABSTRACT

A mining machine is provided which incorporates a detachable cab construction. The mining machine includes a clamping mechanism including a pair of a clamping hook assemblies for releasably clamping the cab body, and a lift cylinder for raising and lowering the cab body. In operation, the cab is detached from the mining machine in a safe area and the mining machine trammed into a mining position. The cab is equipped with remote controls so that operation of the mining machine can be controlled from the cab while the latter is located in a safe area. A safety interlock system prevents operation of local machine-mounted controls until the cab is re-mounted on the mining machine.

7 Claims, 9 Drawing Figures

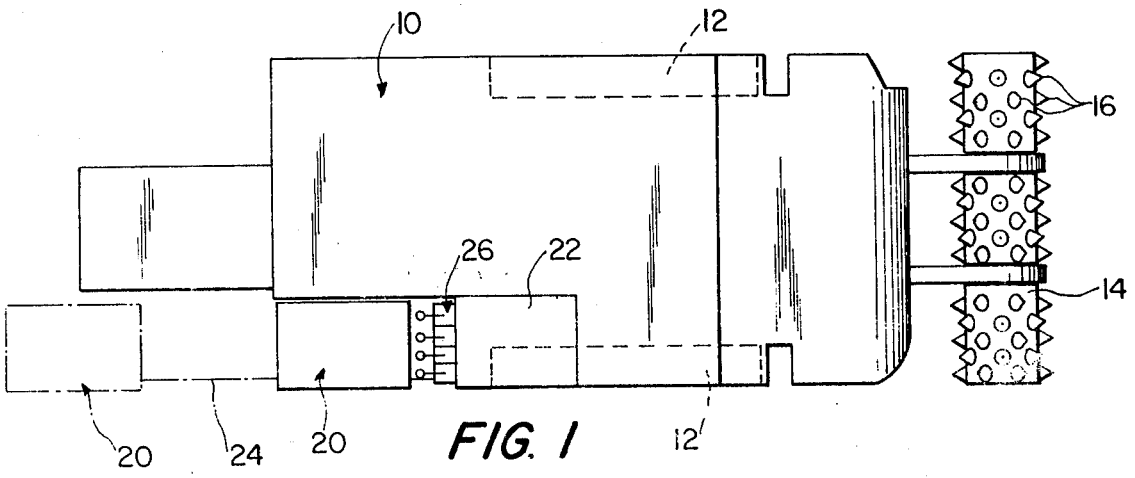
FIG. 1
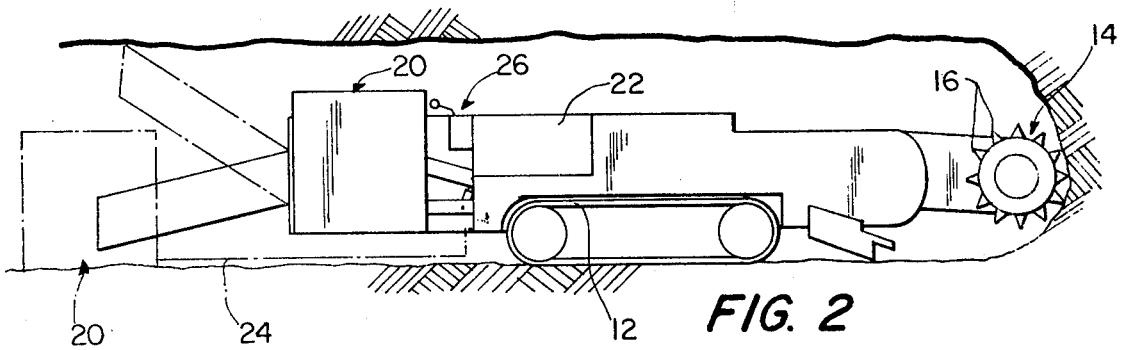
FIG. 2
FIG. 8
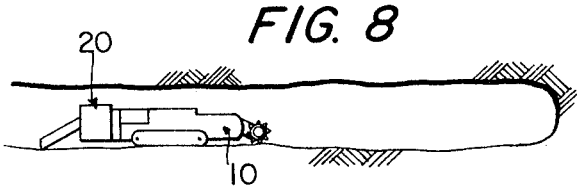
FIG. 9
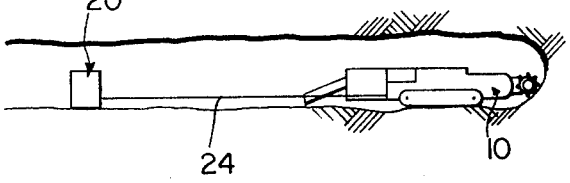
FIG. 3
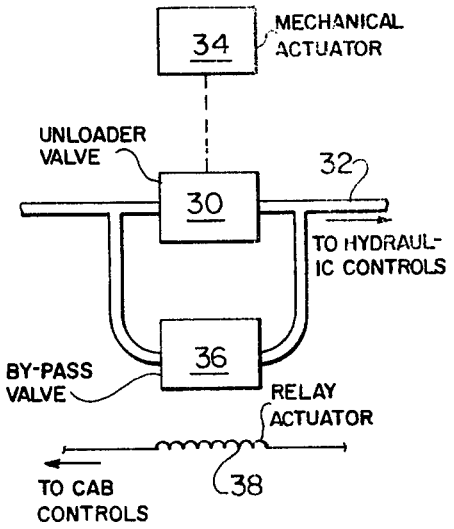

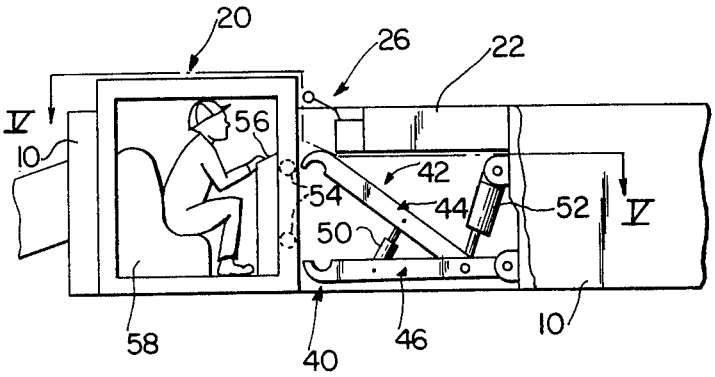
FIG. 4
FIG. 5
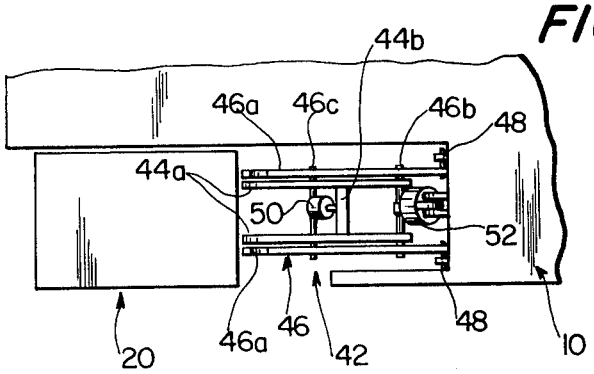
FIG. 6
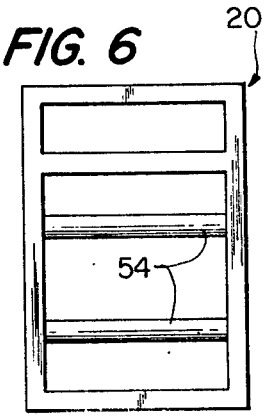
FIG. 7
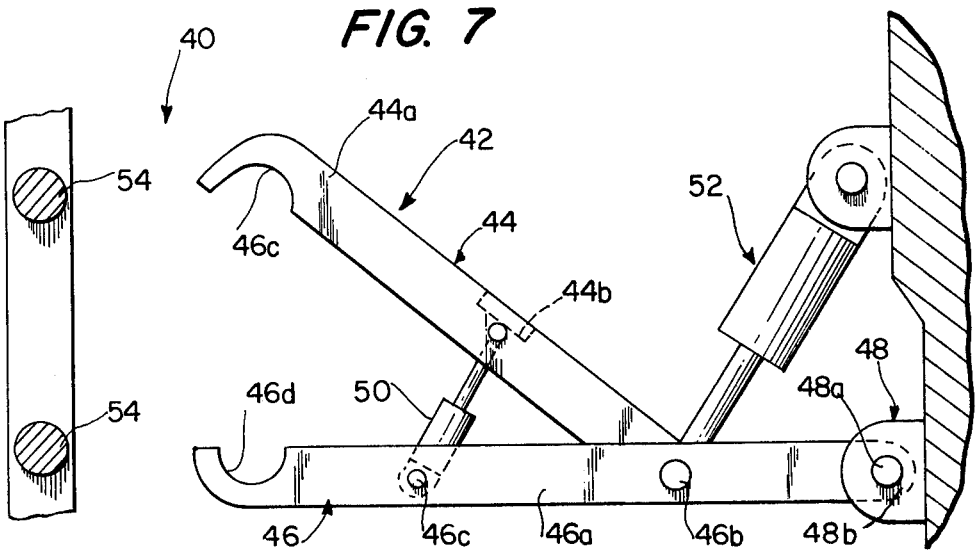

DETACHABLE CAB CONSTRUCTION FOR MINING MACHINES

FIELD OF THE INVENTION

The present invention relates to mining machines for mining coal and the like and, more specifically, to a detachable cab construction for such mining machines.

BACKGROUND OF THE INVENTION

The operator of a mining machine is exposed to a variety of dangers including those associated with the mine itself and those associated with the machinery used in the mine. These dangers include roof falls, "rib rolls", "equipment squeezes", and "runovers". To lessen these dangers, a number of approaches have been taken in an attempt to protect the operator. One approach has been to provide for remote control of the mining machine so that the operator does not have to ride the machine to the situs of the actual mining operation but can operate the machine at a distance from the machine. Conventionally, operators of such remote controlled machines have stood unprotected under the supported roof. Thus, although they are removed from the point where the actual mining of coal takes place, the operators still are vulnerable to other dangers such as so-called"rib rolls" or dangers from moving machinery such as shuttle cars.

Another approach to this problem would be to place the operator in the cab of a separate self-propelled vehicle and thus enable him to remotely operate the mining macnine from the vehicle after the vehicle has been propelled to a safe location. However, this approach is obviously expensive and increases the complexity of the mining section, with the addition of a further motorized vehicle.

A further approach involves locating the operator in a protective structure which is towed into position by the mining machine. The chief drawback of this approach is the lack of manueverability provided thereby, with backing out of an entry providing particular difficult problems.

Examples of patented machines which are representative of attempts to better protect the operator of mining machines and the like are found in U.S. Pat. Nos. 3,768,574 (Long); 3,210,122 (Moon); 3,776,594 (Ewing); and 3,784,159 (Skattman), although this listing is, of course, far from exhaustive.

SUMMARY OF THE INVENTION

In accordance with the invention, a detachable cab construction for a mining machine is provided which overcomes the problems of the prior art discussed above. The invention provides for detachment of the cab from the mining machine itself, and for remote operation of the machine from the detached cab. Thus, the cab can be detached in a relatively safe area and the mining machine moved forward into the workplace under the control of the operator in the cab. The provision of a separable cab provides a substantial increase in protection as compared with conventional remote control systems wherein, as noted, the remote operator, while removed from the workplace, i.e., the situs of the actual mining operation, is still vulnerable to other hazards such as "rib rolls" and moving machinery. Further, the detachable cab construction of the invention is considerably less expensive to implement than a separate, self-propelled cab, and provides markedly increased maneuverability as compared with a towed cab.

According to a preferred embodiment, the cab is attached and detached from the mining machine proper by means of a pair of clamping hook assemblies which releasably engage a pair of clamping bars located on the cab. A lift cylinder connected to the clamping hood assemblies provides raising and lowering of the cab. A clamping cylinder provides opening and closing of the clamping hood assemblies and hence detachment and attachment of the cab.

A further feature of the invention concerns the provision of a safety interlock system. Local manual operating controls are preferably mounted on the machine and stay with the machine when the cab is detached. The safety interlock system prevents operation of the local controls in the absence of the cab., i.e., when the cab is detached. The remote controls in the cab provide for bypassing of the interlock system so that remote operation can take place. It will be appreciated that the purely mechanical local controls provide a very reliable secondary control system for the mining machine.

Other features and advantages of the invention will be set forth in, or apparent from, a detailed description of a preferred embodiment found hereinbelow.

BRIEF DESCRIPTION OF THE DRAWINGS

FIG. 1 is a highly schematic plan view of a mining machine incorporating the detachable cab construction, with the cab shown in the detached state thereof in dashed lines;

FIG. 2 is a side elevational view of the mining machine of FIG. 1;

FIG. 3 is a schematic diagram of a safety interlock system which is part of the cab construction of the invention;

FIG. 4 is a side elevational view of the cab construction of the invention, to an enlarged scale, and with the machine broken away, illustrating the detachment mechanism;

FIG. 5 is a plan view of the clamping mechanism of FIG. 4, taken generally along lines V—V of FIG. 4;

FIG. 6 is an end elevation of the cab of the invention illustrating the clamping bars;

FIG. 7 is a detail of the clamping construction shown in FIG. 4, drawn to an enlarged scale; and FIGS. 8 and 9 are schematic representations of the mining machine of the invention in operation, illustrating two operational modes.

DESCRIPTION OF THE PREFERRED EMBODIMENTS

Referring first to FIGS. 1 and 2, there is shown, in a highly schematic manner, a mining machine incorporating the detachable cab construction of the invention. It will be understood that the mining machine of the invention can take a number of different forms and only those parts of the machine which form a part of or directly cooperate with the detachable cab construction of the invention will be considered in detail. Thus, reference is made to the patents referred to above and to other conventional mining machines for details of the mining machine of FIGS. 1 and 2 which are not described here.

The mining machine of FIGS. 1 and 2 basically comprises a vehicle body 10 which is mounted on and is propelled by a pair of drive tracks 12. The machine also includes a suitable rotatable mining or digging head 14 located at the forward end thereof. Mining head 14 would, of course, include suitable cutting blade, teeth or the like, indicated schematically at 16, for cutting the coal or other material. Thus, very briefly, tracks 12 are used to propel the vehicle body 10 into the desired location where the mining head 14 is operated to effect cutting and digging out of the coal or other material sought to be extracted.

A cab 20 is detachably mounted on vehicle body 10 at a rearward, lateral position as illustrated. Cab 20 is mounted adjacent a control console 22 which is used to control propulsion of the vehicle as well as the various mining machine operations. Cab 20 is connected to control console 22 through a remote control line 24 so that cab 20 can be detached from the vehicle body 10 and left behind. With cab 20 mounted on vehicle body 10, the operator has direct manual control of the control console 22 and hence the various machine operations controlled therefrom. Thus, the mining operation can be remotely controlled with cab 20 detached or directly with cab 20 in place on vehicle body 10.

In accordance with an important safety feature of the invention, a safety interlock is provided which prevents the local machine mounted controls, which are indicated schematically at 26, from being operated in the absence of the cab 20, i.e., with cab 20 demounted from the vehicle body 10. In an exemplary embodiment illustrated schematically in FIG. 3, an unloader valve 30 is provided in a hydraulic inlet line 32 which remains open until the cab 20 is in place on the vehicle 10. Closing of unloader valve 30 is effected by a mechanical actuator indicated at 34 responsive to the seating on the cab 20 on vehicle body 10. Mechanical actuation of the valve 30 can, of course, be accomplished in a number of ways and actuator 34 can comprise a simple control arm located in the chassis of vehicle body 10 which is normally biassed out of an actuating position and which is disposed so as to be swung to an actuating position when cab 20 is brought into place. In order to provide remote operation, a normally open, electrically controlled bypass valve 36 is connected in parallel with unloader valve 30. Bypass valve 36 is controlled by a relay actuator which is connected through remote control line 24 to the remote control console in cab 20. When actuated, valve 36 bypasses valve 30 so that the machine operations can be controlled from the cab 20 from a remote location. It will be understood that the embodiment described is only exemplary and that this safety interlock feature can be provided in other ways.

Referring to FIGS. 4 to 6, a preferred embodiment of the attachment and detachment mechanism is illustrated. This mechanism basically comprises a clamping assembly whereby the cab 20 is detachably clamped to the vehicle body 10. This assembly, which is generally denoted 40, includes clamping mechanism 42 which is disposed on vehicle body 10 and a pair of clamping bars 54 which are provided at the front of cab 20 and are best seen in FIGS. 6 and 7.

Clamping mechanism 42 includes an upper hook assembly 44 which is pivotably mounted on a lower hook assembly 46 which is, in turn, pivotably connected to vehicle body 10. As shown in FIG. 5, upper hook assembly 44 includes a pair of laterally spaced hook arms **44*a*, 44*a* which are connected together by a connecting bar 44*b*. The hook arms 44*a*,44*a* each include a downwardly facing clamping hook 44*c* at the free end thereof and each is pivotably mounted at the other end thereof to a cross bar 46*b* of the lower hook assembly 46**.

Lower hook assembly 46 also includes a pair of hook arms **46*a*,46*a* which are pivotably mounted to vehicle body 10 by means of individual mounting assemblies 48 including pivot shafts 48*a* and mounting brackets 48*b*. Arms 46*a*, 46*a* are jointed together by cross bar 46*b* referred to above and a second cross bar 46*c*. Each arm 46*a* includes an upwardly facing clamping hook 46*a*** at the free end.

A clamping cylinder 50, disposed between connecting bar **44*b* of upper hook assembly 44 and cross bar 46*c* of lower hook assembly 46, controls movement of arms 44*a*,44*a* towards and away from arms 46*a*,46*a* so as to control opening and closing of the clamping mechanism. A lift cylinder 52, attached to cross bar 46*b* at one end and pivotably mounted at the other end to vehicle body 10, controls raising and lowering of the clamping mechanism and thus raising and lowering of the cab 20. It will be appreciated that because of the relative simplicity of clamping mechanism 42**, a conventional mining machine can be readily adapted to employ said mechanism.

As noted hereinabove, cab 20 includes upper and lower horizontal attachment bars 54 which are mounted in vertically spaced relationship in the front of upper cab 50. Bars 54 are rounded to engage the reciprocally shaped clamping hook portions **46*c*,46*c* and 46*d*,46*d*, respectively, of clamping arms 44*a*,44*a* and 46*a*,46*a*. As is best seen in FIG. 4, cab 20 also includes the remote control console referred to above and denoted 56 in FIG. 4. Cab 20 also includes a suitable seat 58 for the operator, and in general, is otherwise designed to be sufficiently roomy to accommodate an operator and the remote control console 56 and to protect the operator in accordance with the requirements of the law. Conventional cabs, of course, include similar controls so that the only unique feature of the cab itself is the provision of the clamping bars 54**.

Considering a complete cycle in the operation of the detachable cab construction of the invention, the "release" portion of the cycle begins by tramming the mining machine 10 into a position to release or detach the cab 20 in a safe area in the mine. This is illustrated schematically in FIG. 8. The cab 20 is then lowered to the floor of the mine using lift cylinder 52. At this time, clamping cylinder 50 is released, thereby providing disengagement of the hook assemblies 44 and 46 of clamping mechanism 42 from the clamping bars 54. The clamping mechanism is then raised by lift cylinder 52 and the machine 10 is trammed ahead to a mining position such as is indicated in FIG. 9. The machine 10 when in place is operated remotely from cab 20 through means of remote control line 24.

The "recovery" portion of the cycle begins by putting the mining machine 10 in to reverse drive. When the machine is positioned adjacent to the cab 20, the clamping mechanism 42 is lowered by means of lift cylinder 52 prior to the engagement of the hook assemblies 44 and 46 with bars 54. The hook assemblies 44,46 are then engaged with bars 54, using the tramming controls and the clamp cylinder 50. When the cab 20 is in full engagement, lift cylinder 52 is used to raise the attached cab 20 into position on the mining machine 10.

A manual winch (not shown) is preferably provided where the mining machine is to be used in particularly hazardous areas so that the cab can be brought safely up to a disabled machine. Once the cab is connected to the machine, the local manual controls, denoted 26 in the drawings, can be used to withdraw the machine to a place of safety.

Although the invention has been described relative to exemplary embodiments thereof, it will be understood that other variations and modifications can be effected in these embodiments without departing from the scope and spirt of the invention.

I claim:

1. In combination, a mining machine and a detachable cab for said mining machine, said combination comprising remotely controlled means operably interrelating said mining machine and said cab including means for detachably mounting said cab on said mining machine for movement therewith and for detaching said cab from said mining machine so that said mining machine can move independently of any movement of said detached cab from a then normally stationary disposition thereof, said remotely controlled means comprising clamping means for releasably clamping said detachable cab into position on said mining machine, and said cab including other remote control means located thereon for controlling said mining machine when said cab is detached therefrom.

2. The combination claimed in claim 1 wherein the mining machine further comprises means for raising and lowering said clamping means.

3. The combination as claimed in claim 1 wherein said clamping means comprises upper and lower clamping hook assemblies and means for moving said clamping hook assemblies into and out of engagement with said cab, said mining machine further comprising means for raising and lowering said clamping hook assemblies.

4. The combination as claimed in claim 3 said moving means comprising a hydraulic clamping cylinder.

5. The combination as claimed in claim 1 wherein said cab includes remote operating controls for said mining machine located therein and said mining machine includes local operating controls for said machine mounted thereon, said combination further including safety interlock means for preventing operation of said local operating controls when said cab is detached from said mining machine, said remote controls including means for providing bypassing said safety interlock means.

6. The combination as claimed in claim 1 wherein said clamping means comprises upper and lower clamping hook assemblies and means for moving said clamping hook assemblies into and out of engagement with said cab, said mining machine further comprising means for raising and lowering said clamping hook assemblies, and said cab including a pair of vertically spaced clamping bars adapted to be engaged by said clamping hook assemblies, said clamping hook assemblies each comprising a pair of laterally spaced clamping hook arms including hook means located at the free ends thereof.

7. In combination, a mining machine and a detachable cab for said mining machine, said combination comprising remotely controlled means operably interrelating said mining machine and said detachable cab including means for detachably mounting said cab on said mining machine for movement therewith and for detaching said cab from said mining machine so that said mining machine can move independently of any movement of said detached cab from a then normally stationary disposition thereof, said mining machine including operating controls mounted thereon and said combination further comprising safety interlock means for prevention operation of said operating controls when said cab is detached from said mining machine, and said cab including other remote control means located thereon for remotely controlling said mining machine when said cab is detached therefrom.

* * * * *